US006581668B1

(12) United States Patent
Oakley

(10) Patent No.: US 6,581,668 B1
(45) Date of Patent: Jun. 24, 2003

(54) WINDOW FRAME FOR A FENCE

(76) Inventor: Keven W. Oakley, 244 Beaconsfield TCE, Brighton, Queensland QLD 4215 (AU)

( * ) Notice: Subject to any disclaimer, the term of this patent is extended or adjusted under 35 U.S.C. 154(b) by 124 days.

(21) Appl. No.: 09/770,261

(22) Filed: Jan. 26, 2001

(51) Int. Cl.[7] ..... E06B 9/24; E06B 7/28; E06B 3/00; E04C 2/38

(52) U.S. Cl. ..... 160/380; 160/371; 160/180; 52/208; 52/656.7; 52/656.5

(58) Field of Search ..... 52/204.1, 205, 52/208, 204.65, 455, 656.2, 656.7, 656.5; 256/1, 24; 160/371, 380, 180

(56) References Cited

U.S. PATENT DOCUMENTS

| | | | | | |
|---|---|---|---|---|---|
| 705,278 | A | * | 7/1902 | McKeever | 160/105 |
| 1,472,663 | A | * | 10/1923 | Miller | 160/92 |
| 2,356,878 | A | * | 8/1944 | Painter | 156/101 |
| 2,567,353 | A | * | 9/1951 | Ryan | 52/208 |
| 3,903,669 | A | * | 9/1975 | Pease et al. | 411/339 |
| 4,127,156 | A | * | 11/1978 | Brandt | 160/179 |
| 4,221,038 | A | * | 9/1980 | Singer et al. | 160/371 |
| 4,334,573 | A | * | 6/1982 | Hackman et al. | 160/180 |
| 4,788,934 | A | | 12/1988 | Fetter | |
| 4,856,575 | A | * | 8/1989 | Wells | 160/116 |
| 4,947,597 | A | * | 8/1990 | Simpson | 52/204.591 |
| 4,982,530 | A | * | 1/1991 | Palmer | 49/501 |
| 4,989,546 | A | | 2/1991 | Cannaday | |
| 5,165,366 | A | | 11/1992 | Harvey | |
| 5,195,461 | A | | 3/1993 | Brown | |
| 5,287,654 | A | * | 2/1994 | Davlantes | 47/56 |
| D367,733 | S | | 3/1996 | Paxman et al. | |
| 5,535,804 | A | * | 7/1996 | Guest | 160/180 |
| 5,671,697 | A | | 9/1997 | Rutman | |
| 5,765,325 | A | * | 6/1998 | DeBlock | 52/204.5 |
| 5,894,706 | A | * | 4/1999 | Herbst | 52/204.71 |
| 6,079,475 | A | * | 6/2000 | Morgan | 52/202 |
| 6,151,849 | A | * | 11/2000 | Twigg | 52/208 |

* cited by examiner

*Primary Examiner*—Carl D. Friedman
*Assistant Examiner*—Kevin McDermott

(57) ABSTRACT

A window frame for positioning in a fence. The window frame includes a first frame having a first side, a second side, an outer perimeter edge, and an inner perimeter edge. A shoulder is integrally coupled to and extends away from the outer perimeter edge. The second side has a plurality of slots extending therein. The first frame has a shape substantially identical to the opening in the fence. A screen member is securely attached to the inner perimeter edge such that the screen member extends across the first frame. A plurality of fastening means removably fastens the first frame to the fence wall. A second frame has an inside surface and an outside surface. The inside surface is adapted to cover the second side of the first frame and has a plurality of protruding members thereon, each positioned to be removably extended into one of the slots.

3 Claims, 3 Drawing Sheets

WINDOW FRAME FOR A FENCE

BACKGROUND OF THE INVENTION

1. Field of the Invention

The present invention relates to window frames and more particularly pertains to a new window frame for a fence for positioning in a fence so that pets may view out of a fenced-in area.

2. Description of the Prior Art

The use of window frames is known in the prior art. More specifically, window frames heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,989,546; U.S. Patent No. 5,195,461; U.S. Pat. No. 5,671,697; U.S. Des. Pat. No. 367,733; U.S. Pat. No. 5,165,366; and U.S. Pat. No. 4,788,934.

While these devices fulfill their respective, particular objectives and requirements, the aforementioned patents do not disclose a first frame having a first side and a second side. The first frame has an outer perimeter edge and an inner perimeter edge. A shoulder is integrally coupled to and extends away from the outer perimeter edge. The second side has a plurality of slots extending therein. The first frame has a shape substantially identical to the opening in the fence. A screen member is securely attached to the inner perimeter edge such that the screen member extends across the first frame. A plurality of fastening means removably fastens the first frame to the fence wall. A second frame has an inside surface and an outside surface. The inside surface has a size and shape adapted to cover the second side of the first frame. The inside surface has a plurality of protruding members thereon. Each of the protruding members is positioned to be removably extended into one of the slots.

In these respects, the window frame for a fence according to the present invention substantially departs from the conventional concepts and designs of the prior art, and in so doing provides an apparatus primarily developed for the purpose of positioning in a fence so that pets may view out of a fenced-in area.

SUMMARY OF THE INVENTION

In view of the foregoing disadvantages inherent in the known types of window frames now present in the prior art, the present invention provides a new window frame for a fence construction wherein the same can be utilized for positioning in a fence so that pets may view out of a fenced-in area.

The general purpose of the present invention, which will be described subsequently in greater detail, is to provide a new window frame for a fence apparatus and method which has many of the advantages of the window frames mentioned heretofore and many novel features that result in a new window frame for a fence which is not anticipated, rendered obvious, suggested, or even implied by any of the prior art window frames, either alone or in any combination thereof.

To attain this, the present invention generally comprises a first frame having a first side and a second side. The first frame has an outer perimeter edge and an inner perimeter edge. A shoulder is integrally coupled to and extends away from the outer perimeter edge. The second side has a plurality of slots extending therein. The first frame has a shape substantially identical to the opening in the fence. A screen member is securely attached to the inner perimeter edge such that the screen member extends across the first frame. A plurality of fastening means removably fastens the first frame to the fence wall. A second frame has an inside surface and an outside surface. The inside surface has a size and shape adapted to cover the second side of the first frame. The inside surface has a plurality of protruding members thereon. Each of the protruding members is positioned to be removably extended into one of the slots.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new window frame for a fence apparatus and method which has many of the advantages of the window frames mentioned heretofore and many novel features that result in a new window frame for a fence which is not anticipated, rendered obvious, suggested, or even implied by any of the prior art window frames, either alone or in any combination thereof.

It is another object of the present invention to provide a new window frame for a fence which may be easily and efficiently manufactured and marketed.

It is a further object of the present invention to provide a new window frame for a fence which is of a durable and reliable construction.

An even further object of the present invention is to provide a new window frame for a fence which is susceptible of a low cost of manufacture with regard to both materials and labor, and which accordingly is then susceptible of low prices of sale to the consuming public, thereby making such window frame for a fence economically available to the buying public.

Still yet an other object of the present invention is to provide a new window frame for a fence which provides in the apparatuses and methods of the prior art some of the advantages thereof, while simultaneously overcoming some of the disadvantages normally associated therewith.

Still another object of the present invention is to provide a new window frame for a fence for positioning in a fence so that pets may view out of a fenced-in area.

Yet another object of the present invention is to provide a new window frame for a fence which includes a first frame having a first side and a second side. The first frame has an outer perimeter edge and an inner perimeter edge. A shoulder is integrally coupled to and extends away from the outer perimeter edge. The second side has a plurality of slots extending therein. The first frame has a shape substantially identical to the opening in the fence. A screen member is securely attached to the inner perimeter edge such that the screen member extends across the first frame. A plurality of fastening means removably fastens the first frame to the fence wall. A second frame has an inside surface and an outside surface. The inside surface has a size and shape adapted to cover the second side of the first frame. The inside surface has a plurality of protruding members thereon. Each of the protruding members is positioned to be removably extended into one of the slots.

Still yet another object of the present invention is to provide a new window frame for a fence that allows pets, particularly dogs, to view out of a privacy fence.

Even still another object of the present invention is to provide a new window frame for a fence that is retrofittable to existing fences.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
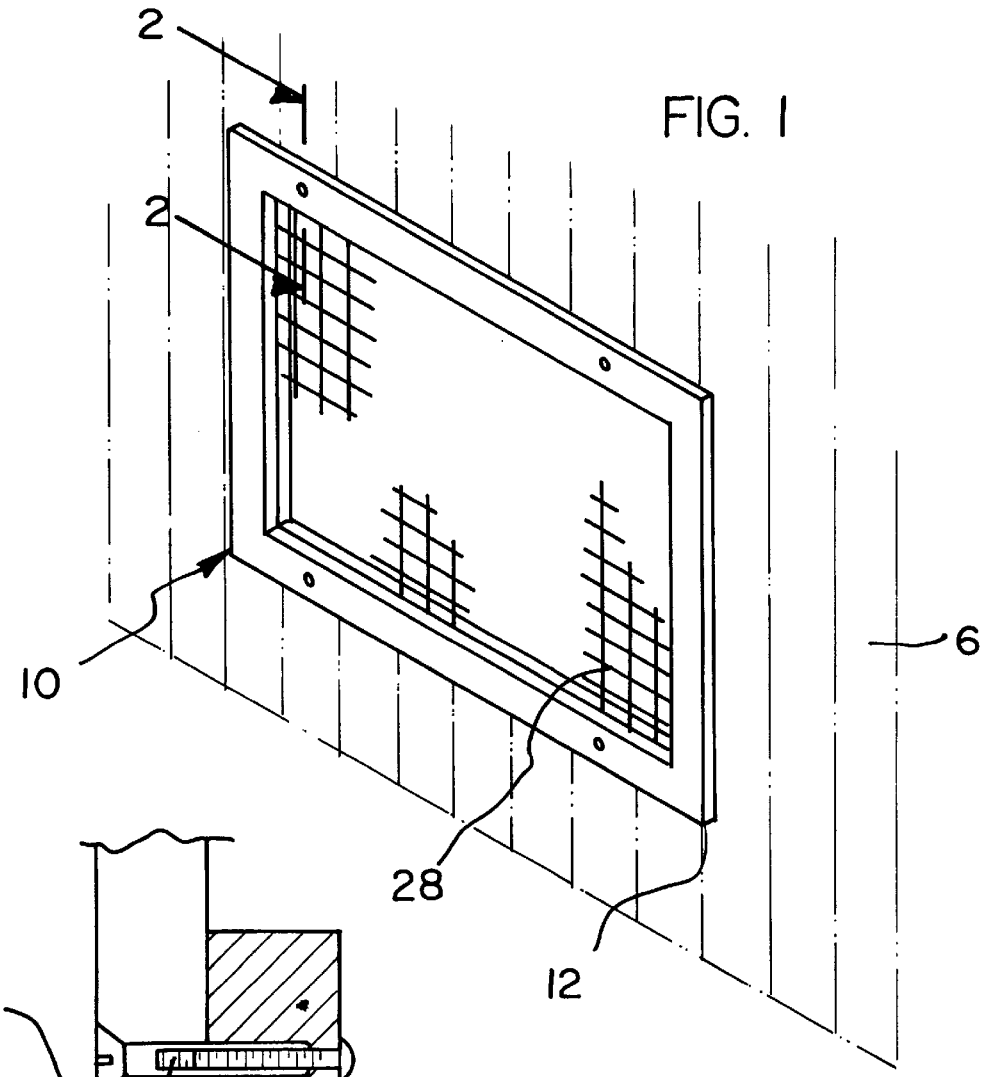
FIG. 1 is a schematic perspective view of a new window frame for a fence according to the present invention.

With reference now to the drawings, and in particular to FIGS. 1 through 6 thereof, a new window frame for a fence embodying the principles and concepts of the present invention and generally designated by the reference numeral 10 will be described.

As best illustrated in FIGS. 1 through 6, the window frame for a fence 10 generally comprises a first frame 12 and a second frame 40. The first frame 12 has a first side 14 and a second side 16. The first frame 12 has an outer perimeter edge 18 and an inner perimeter edge 20. A shoulder 22 is integrally coupled to and extends away from the outer perimeter edge 18. The shoulder 22 abuts a junction of the outer perimeter edge 18 and the first side 14. The second side 16 has a plurality of slots 24 extending therein. The inner perimeter edge 20 has a plurality of holes 26 therein. Each of the holes 26 extends into one of the slots 24. The first frame 12 has a shape substantially identical to an opening in a fence wall 6. The shoulder 22 is abuttable against the fence wall 6 when the first frame 12 is positioned in the opening.

A screen member 28 is securely attached to the inner perimeter edge 20 such that the screen member 28 extends across the first frame 12. The screen member 28 may also be molded into the first frame 12. The screen member 28 preferably comprises a wire mesh. The wire mesh may be the type conventionally used in screen doors, however, ideally the wire mesh uses a wire having a larger diameter to ensure that animals may not break through the mesh. Wider spaced wire or a plastic grid may also be employed. Also envisioned is the use of glass or a transparent plastic which may be used instead of the wire mesh.

A plurality of fastening means 30 removably fastens the first frame 12 to the fence wall 6. Each of the fastening means 30 extends through the first frame 12 and into the fence wall. Each of the fastening means 30 preferably comprises a screw.

The second frame 40 has an inside surface 42 and an outside surface 44. The inside surface 42 has a size and shape adapted to cover the second side 16 of the first frame 12. The inside surface 42 has a plurality of protruding members 46 thereon. Each of the protruding members 46 is positioned to be removably extendable into one of the slots 24. Each of the protruding members 46 has a free end having a nub 48 thereon. Each of the nubs 48 is positioned to releasably engage one of the holes 26.

Figure 2:
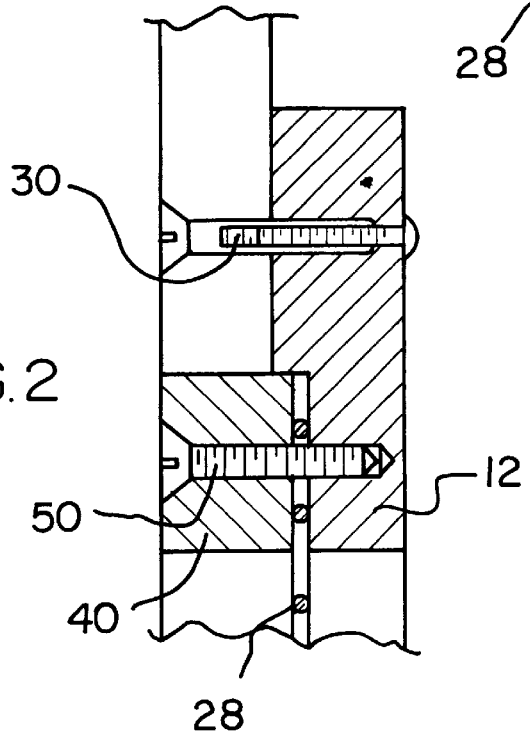
FIG. 2 is a schematic cross-sectional view taken along line 2—2 of the present invention.
Figure 3:
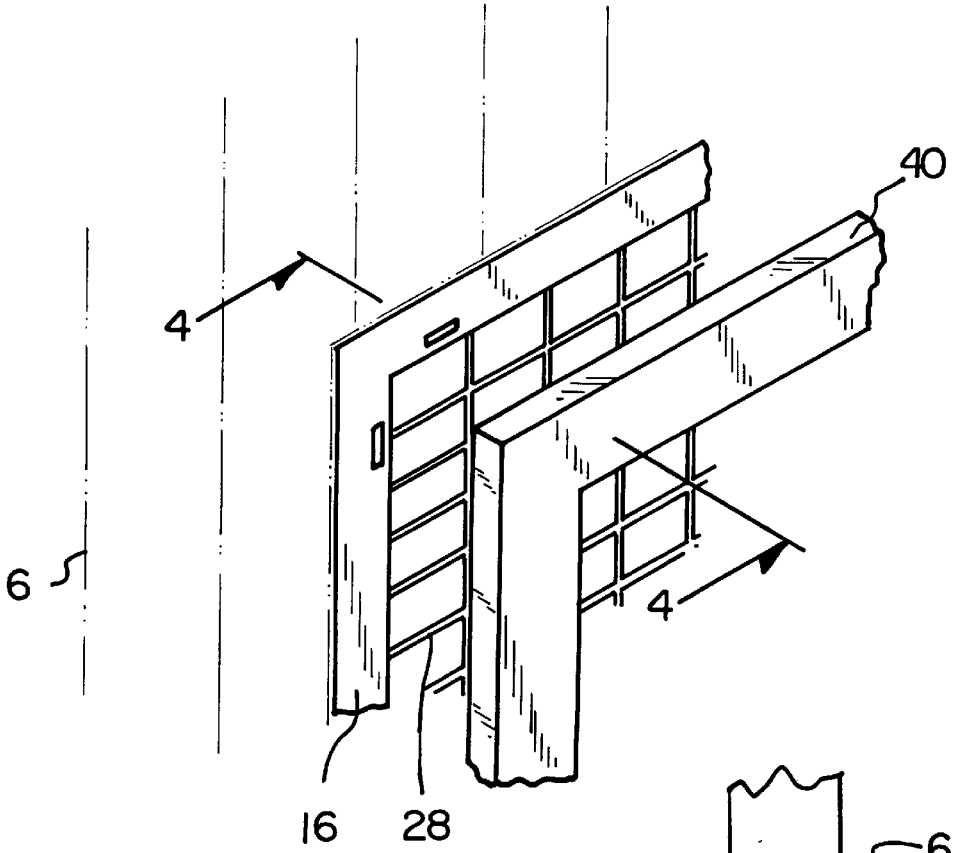
FIG. 3 is a schematic perspective view of the present invention.
Figure 4:
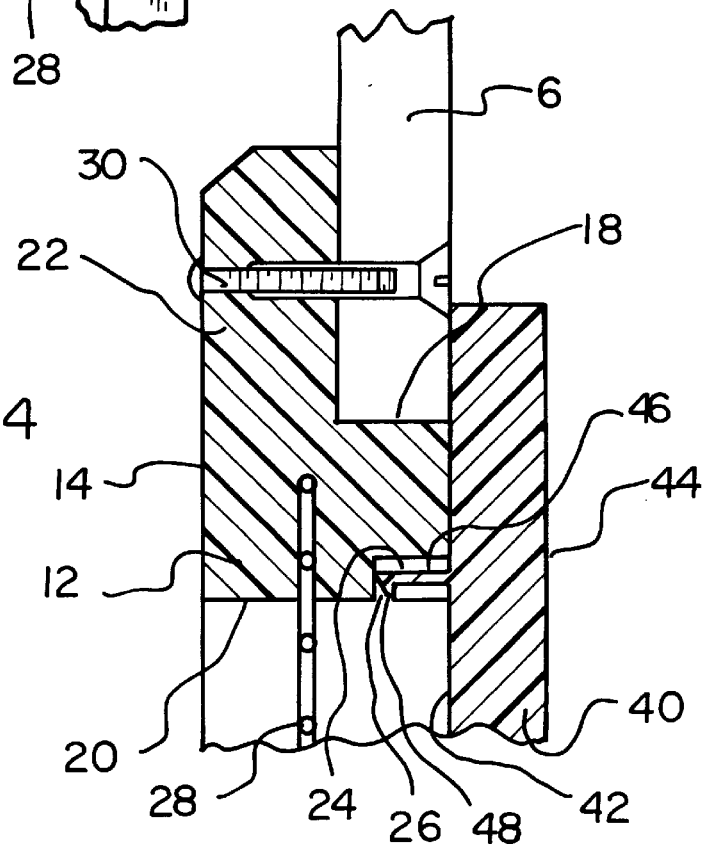
FIG. 4 is a schematic cross-sectional view taken along line 4—4 of the present invention.

The embodiment shown in FIG. 2 has a screen member 28 positioned between the first 12 and second 40 frames. Securing means 50, such as screws, are used to removably secure the second frame 40 to the first frame 12.

Figure 5:
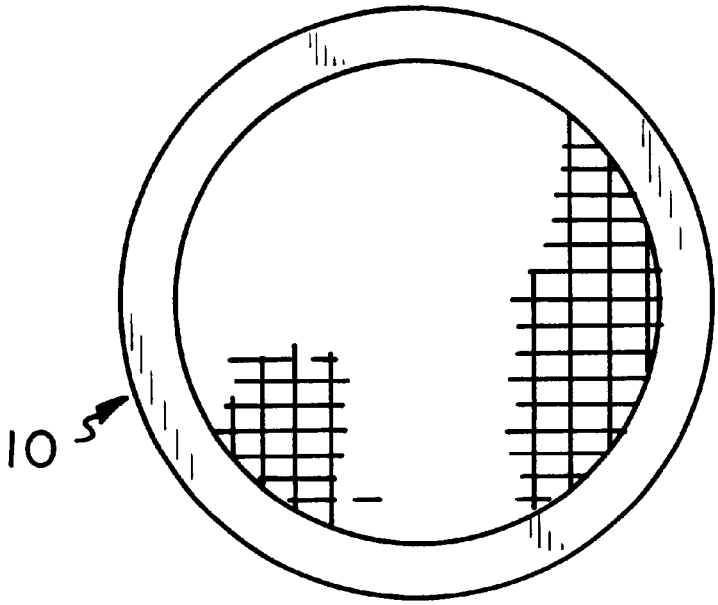
FIG. 5 is a schematic front view of the present invention.
Figure 6:
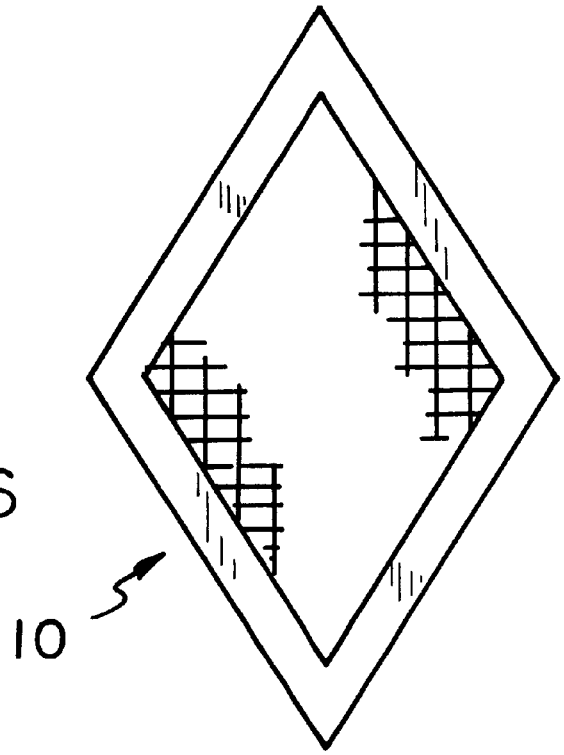
FIG. 6 is a schematic front view of the present invention.

As shown in FIGS. 5 and 6, the first and second frames may have any shape desired.

In use, an opening is cut into the fence wall. The shoulder of the first frame is abutted against the fence wall and fastening means are extending through the shoulder and into the fence wall to hold the first frame in place. The second frame is then secured to the first frame using securing means or the protruding members.

As to a further discussion of the manner of usage and operation of the present invention; the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A window frame assembly, said assembly being positionable in an opening in a fence wall, said fence wall having a first side and a second side, said assembly comprising:

a first frame, said first frame having a first side and a second side, said first frame having an outer perimeter edge and an inner perimeter edge, a shoulder being integrally coupled to and extending away from said outer perimeter edge, said second side having a plurality of slots extending therein, said first frame having a shape substantially identical to said opening in said fence;

a screen member, said screen member being securely attached to said inner perimeter edge such that said screen member extends across said first frame;

a plurality of fastening means for removably fastening said first frame to said fence wall;

a second frame, said second frame having an inside surface and an outside surface, said inside surface having a size and shape adapted to cover said second side of said first frame, said inside surface having a plurality of protruding members thereon, each of said protruding members being positioned to being removably extendable into one of said slots;

said inner perimeter edge having a plurality of holes therein, each of said holes extending into one of said slots; and each of said protruding members having a free end having a nub thereon, each of said nubs being positioned to releasably engage one of said holes.

2. The window frame assembly as in claim 1, wherein said screen member comprises a wire mesh.

3. A window frame assembly, said assembly being positionable in an opening in a fence wall, said fence wall having a first side and a second side, said assembly comprising:

a first frame, said first frame having a first side and a second side, said first frame having an outer perimeter edge and an inner perimeter edge, a shoulder being integrally coupled to and extending, away from said outer perimeter edge, said shoulder abutting a junction of said outer perimeter edge and said first side, said second side having a plurality of slots extending therein, said inner perimeter edge having a plurality of holes therein, each of said holes extending into one of said slots, said first frame having a shape substantially identical to said opening in said fence, wherein said shoulder is abuttable against said fence wall when said first frame is positioned in said opening;

a screen member, said screen member being securely attached to said inner perimeter edge such that said screen member extends across said first frame, said screen member comprising a wire mesh;

a plurality of fastening means for removably fastening said first frame to said fence wall, each of said fastening means extending through said first frame and into said fence wall; and a second frame, said second frame having an inside surface and an outside surface, said inside surface having a size and shape adapted lo cover said second side of said first frame, said inside surface having a plurality of protruding members thereon, each of said protruding members removably extendable into one of said slots, each of said protruding members having a free end having a nub thereon, each of said nubs being positioned to releasably engage one of said holes.

* * * * *